US005531178A

United States Patent [19]

Abe et al.

[11] Patent Number: 5,531,178

[45] Date of Patent: Jul. 2, 1996

[54] SUPPORT STRUCTURE FOR SELF-STANDING STORAGE TANK IN LIQUIFIED GAS CARRIER SHIP

[75] Inventors: Akinori Abe, Yokohama; Akitoshi Ando, Kamifukuoka, both of Japan

[73] Assignee: Ishikawajima-Harima Heavy Industries Co., Ltd., Tokyo, Japan

[21] Appl. No.: 328,606

[22] Filed: Oct. 25, 1994

Related U.S. Application Data

[63] Continuation of Ser. No. 182,779, Jan. 18, 1994, abandoned.

[30] Foreign Application Priority Data

May 27, 1993 [JP] Japan ..... 5-126373
May 27, 1993 [JP] Japan ..... 5-126374

[51] Int. Cl.[6] ..... B63B 25/08

[52] U.S. Cl. ..... 114/74 A; 220/901

[58] Field of Search ..... 114/72, 74 R, 114/74 T, 74 A, 75, 76, 88; 220/901

[56] References Cited

U.S. PATENT DOCUMENTS

| | | | |
|---|---|---|---|
| 2,905,352 | 6/1958 | Henry . | |
| 3,425,583 | 2/1969 | Bridges . | |
| 3,583,351 | 6/1971 | Gorman | 114/74 A |
| 3,605,425 | 9/1971 | Cuneo et al. | 114/74 A |
| 3,612,333 | 10/1971 | Cowles | 114/74 A |
| 3,839,981 | 10/1974 | Gilles . | |
| 3,937,353 | 2/1976 | Becker et al. . | |
| 4,095,546 | 6/1978 | Kane | 114/74 A |

FOREIGN PATENT DOCUMENTS

| | | |
|---|---|---|
| 1227729 | 8/1960 | France . |
| 2083116 | 11/1971 | France . |
| 2168674 | 8/1973 | France . |
| 2200475 | 4/1974 | France . |
| 1506761 | 4/1970 | Germany . |
| 1781041 | 10/1970 | Germany . |
| 2249796 | 3/1989 | Japan . |
| 0048999 | 4/1990 | Japan . |
| 0492794 | 8/1990 | Japan . |
| 4143187 | 10/1990 | Japan . |

*Primary Examiner*—Stephen Avila
*Attorney, Agent, or Firm*—Pearne, Gordon, McCoy & Granger

[57] ABSTRACT

A support structure for a self-standing storage tank used in a liquefied gas carrier ship is disclosed. The carrier ship comprises a hold for housing the storage tank. Between a bottom section of the tank and a bottom surface of the hold, lateral movement restraining devices for restraining the lateral movements of the tank and fore-aft movement restraining devices for restraining the longitudinal movements of the tank are disposed. Between a roof section of the tank and a roof surface of the hold, only lateral movement restraining devices are disposed.

13 Claims, 11 Drawing Sheets

SUPPORT STRUCTURE FOR SELF-STANDING STORAGE TANK IN LIQUIFIED GAS CARRIER SHIP

This is a continuation of application Ser. No. 08/182,779, filed Jan. 18, 1994 now abandoned.

BACKGROUND ART

The present invention relates to a support structure for a self-standing storage tank used in a liquefied gas carrier ship, and more specifically, to a technology which avoids problems due to relative movements of a self-standing storage tank and a ship's hull of the liquefied gas carrier ship in the forward and rearward directions, and which improves support of the self-standing storage tank during the movement thereof.

Techniques relating to liquefied gas carrier ships have been disclosed in, for example, Japanese Patent Application, First Publication No. 2-249796, Japanese Patent Application, First Publication No. 4-8999, Japanese Patent Application, First Publication No. 4-92794, and Japanese Patent Application, First Publication No. 4-143187.

An example of these types of liquefied gas carrier ships is shown in FIGS. 10 and 11. This carrier ship has a double casing type (armored-type) ship's hull 1 including a outer shell 1A and an inner shell 1B, and rectangular-shaped storage tanks 3 in holds 2 of the ship's hull 1. The storage tank 3 has a self-standing structure which is independent of the inner shell 1B. By this structure, a carrier ship may be contemplated in which a deck 12 is flattened, the storage capacity is increased, safety during an accident (such as running aground) is improved, and reliability in carrying a stored liquid, such as liquefied natural gas (LNG), is improved.

Each of the storage tanks 3 is placed on a plurality of support blocks 4, as shown in FIG. 11, so that the weight of the tank 3 is distributed. Between the inner shell 1B and the tank 3, fore-aft movement restraining devices for restraining the movement of the tank 3 in the forward and rearward directions, and lateral movement restraining devices for restraining the movement of the tank 3 in the port-starboard directions, are disposed. More specifically, the fore-aft movement restraining devices and the lateral movement restraining devices are disposed between a roof surface 2*a* of the hold 2 and a roof section 3*a* of the tank 3, and between a bottom surface 2*b* of the hold 2 and a bottom section 3*b* of the tank 3.

FIG. 12 shows the fore-aft movement restraining devices 5 and the lateral movement restraining devices 6, which are disposed between the roof surface 2*a* of the hold 2 and the roof section 3*a* of the tank 3. The fore-aft movement restraining devices 5 are aligned in the port-starboard directions (the widthwise direction of the ship), defining the center of a tank dome 9 as a restraining base point of movement. Likewise, the fore-aft movement restraining devices 5 are disposed between the bottom section 3*b* of the tank 3 and the bottom surface 2*b* of the hold 2. The fore-aft movement restraining devices 5 restrain the relative movements of the inner shell 1B and the tank 3 in the forward and rearward directions, while permitting the relative movements of the inner shell 1B and the tank 3 in the port-starboard directions.

The lateral movement restraining devices 6 are aligned along the longitudinally extending center line Y of the tank 3, as shown in FIGS. 11 and 12, and restrain the relative lateral movements of the inner shell 1B and the tank 3, permitting the fore-aft relative movements of the inner shell 1B and the tank 3. The lateral movement restraining devices 6 are also provided between the bottom section 3*b* of the tank 3 and the bottom surface 2*b* of the hold.

The carrier ship having the support blocks 4, the fore-aft movement restraining devices 5, and the lateral movement restraining devices 6 are designed so as to bear, for example, an acceleration of 0.5 G (gravity) of a collision load. The share of the load is, for example, 0.45 G for friction load at the support blocks 4 disposed at the lower position of the tank 3, 0.02 G at the fore-aft movement restraining devices 5 disposed at the upper position of the same, and 0.03 G at the fore-aft movement restraining devices 5 disposed at the lower position of the same. By the above structure, the safety of the tanks and the carrier ship is ensured, in that external forces caused by waves or a collision and the like are prevented from being imparted to the tank 3.

The structural specifications of the fore-aft movement restraining devices 5 and the lateral movement restraining devices 6 disposed above the tank 3, and those disposed under the tank 3 are different. The reason for this is that the maximum load to be restrained by the movement restraining devices 5 and 6 disposed above the tank 3 is relatively larger than that of those disposed at the lower position, while the required movement maximum load of the movement restraining devices 5 and 6 disposed under the tank 3 can be reduced by friction of the support blocks 4.

FIG. 13 shows an example of the fore-aft movement restraining device 5 disposed above the tank 3. The movement restraining device 5 comprises a pair of stopping blocks 7 arranged on the roof surface 2*a* of the hold 2 constituted by the inner shell 1B, each block being spaced apart from the other and being formed unitarily with the inner shell 1B, and a chock 8 provided on the roof section 3*a* of the tank 3 and disposed between the pair of stopping blocks 7. Thus, the relative movements of the chock 8 are restrained by the pair of stopping blocks. In this case, the stopping blocks 7 are welded to the roof surface 2*a*, and the chock 8 is welded to the roof section 3*a*. The composition of the lateral movement restraining devices 6 disposed above the tank 3, the fore-aft movement restraining devices 5 and the lateral movement restraining devices 6 disposed under the tank 3 are similar to the above-mentioned movement restraining devices 5.

However, the above-mentioned support structure for a self-standing storage tank may cause the following problems.

That is, as shown in FIG. 14, when the ship's hull 1 bends downwardly in operation, the fore-aft movement restraining devices 5 will work as if they restrain the backward movement of tank 3. Conversely, as shown in FIG. 15, when the ship's hull 1 bends upwardly in operation, the fore-aft movement restraining devices 5 will work as if they restrain the forward movement of tank 3. Because of this, according to the degree of deformation of the ship's hull 1, excessive force will be applied to the fore-aft movement restraining devices 5 disposed at the upper position. Accordingly, there is a problem to be solved in which the movement restraining devices 5 may be easily damaged by loads caused by frequent deformations of the ship's hull 1. Therefore, precise calculations and adjustments are required for the installations of the fore-aft movement restraining devices 5 disposed on the upper position. Furthermore, concerning the chock 8 which constitutes the fore-aft movement restraining device 5 and the lateral movement restraining device 6, particularly in the case in which the chock 8 is welded on an outer surface of the tank 3, substantial analysis of stresses at welded portions is required.

SUMMARY OF THE INVENTION

The present invention was developed in view of the above situation. It is an object thereof to provide a support structure for a self-standing storage tank used in a liquefied gas carrier ship, which can solve the problem with regard to the interactions of the ship's hull and the fore-aft movement restraining devices based on the ship's deformations, and which can simplify and save the labor necessary for adjusting the fore-aft movement restraining devices.

Another object of the present invention is to increase the reliability of the self-standing storage tank by reducing stresses occurring in the portion adjacent to the welded sections of the chock constituting the movement restraining device.

In order to accomplish these objects, the present invention provides:

a support structure for a self-standing storage tank used in a liquid-transport carrier ship, the self-standing storage tank having a roof section and a bottom section, the support structure comprising:

a hold for housing the self-standing storage tank in a self-standing state, the hold having a roof surface facing the roof section of the tank and a bottom surface facing the bottom section of the tank;

lateral movement restraining devices for restraining movements of the tank in the widthwise direction of the ship, the lateral movement restraining devices disposed between the bottom section of the tank and the bottom surface of the hold, and between the roof section of the tank and the roof surface of the hold; and fore-aft movement restraining devices for restraining movements of the tank in the fore-aft direction of the ship;

wherein the fore-aft movement restraining devices are disposed only between the bottom section of the tank and the bottom surface of the hold.

According to the support structure for a self-standing storage tank of the present invention, the upper part of the tank is not restrained in the forward and rearward directions. Therefore, interactions of the storage tank and the ship's hull in the forward and rearward directions can be prevented even if slippage occurs between the top of the tank and the inner upper section of the ship's hull due to deformation of the ship's hull.

When the ship's hull moves relative to the storage tank, the tank is restrained by means of the fore-aft movement restraining devices disposed under the tank.

According to the above structure, installation of the fore-aft movement restraining devices is simplified, and calculations necessary for design and adjustment work for the fore-aft movement restraining devices for the upper position can be omitted, further saving labor.

Furthermore, the occurrence of damage to the inside of the ship's hull can be reduced compared to a structure in which fore-aft movement restraining devices are disposed above the tank, and this makes it possible to reduce the amount of maintenance work necessary on the ship's hull. Additionally, by excluding the interactions of the top of the tank and the inner upper section of the hold, the forces generated by the interactions is prevented from being imparted to other installed equipment, such as pump 10 and pipes 11, disposed at the position of the base point for restraint, and this improves the safe operation of the ship.

DESCRIPTION OF THE PREFERRED EMBODIMENTS

Figure 1:
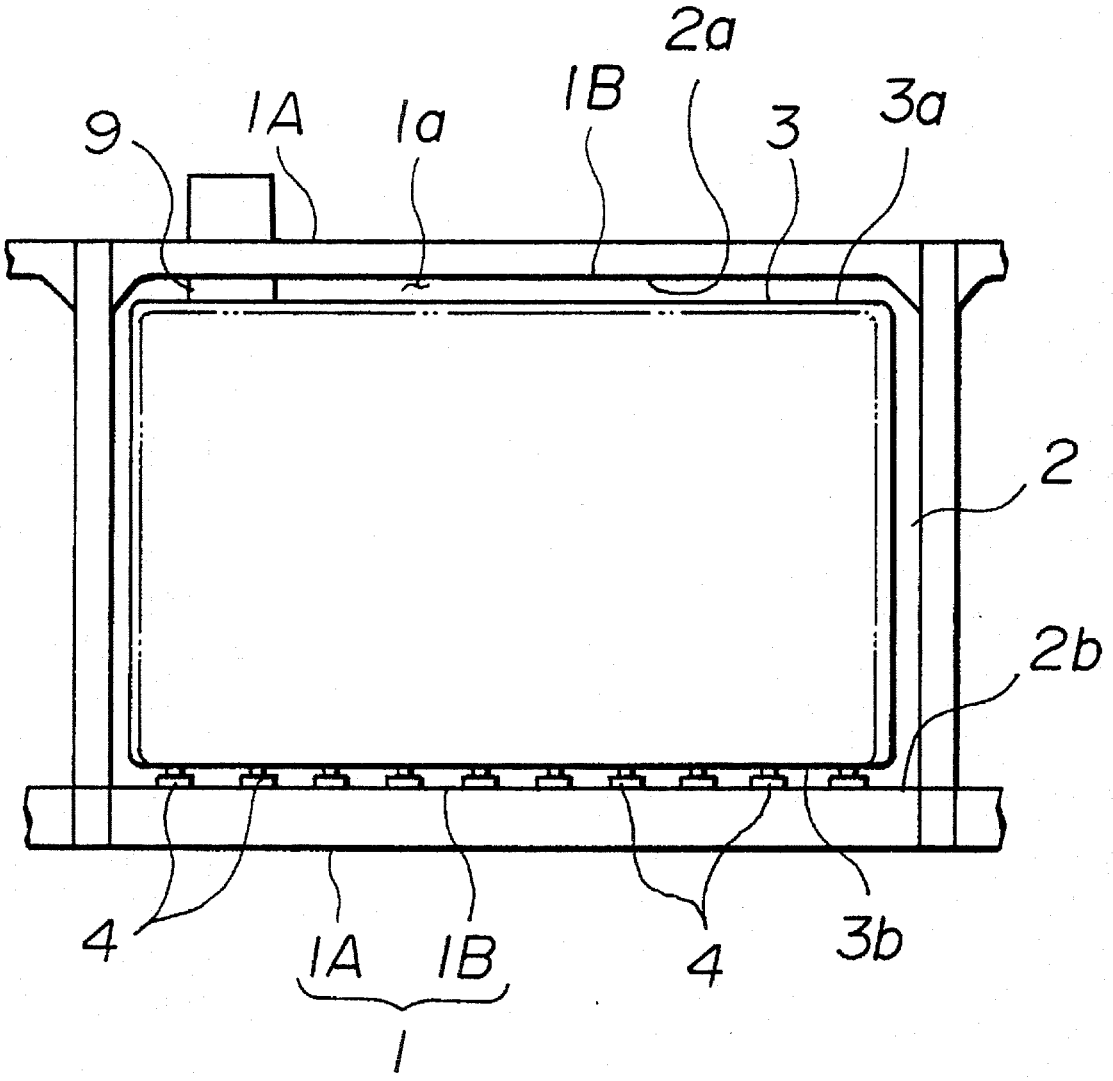
FIG. 1 is a partial side view of a support structure for a self-standing storage tank in a hold of a carrier ship.

Referring to the drawings, FIGS. 1 to 7 relate to the first embodiment of a support structure for a self-standing storage tank in accordance with the present invention.

Figure 10:
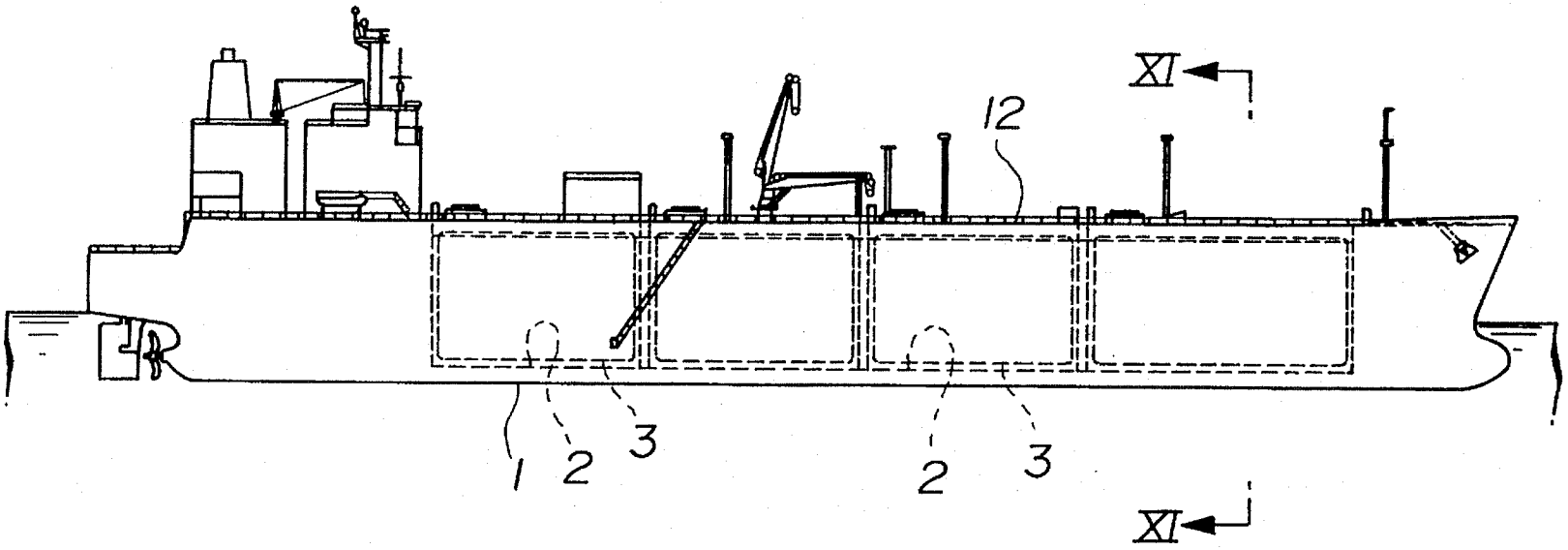
FIG. 10 is a general side view of a liquid-transport carrier ship.
Figure 11:
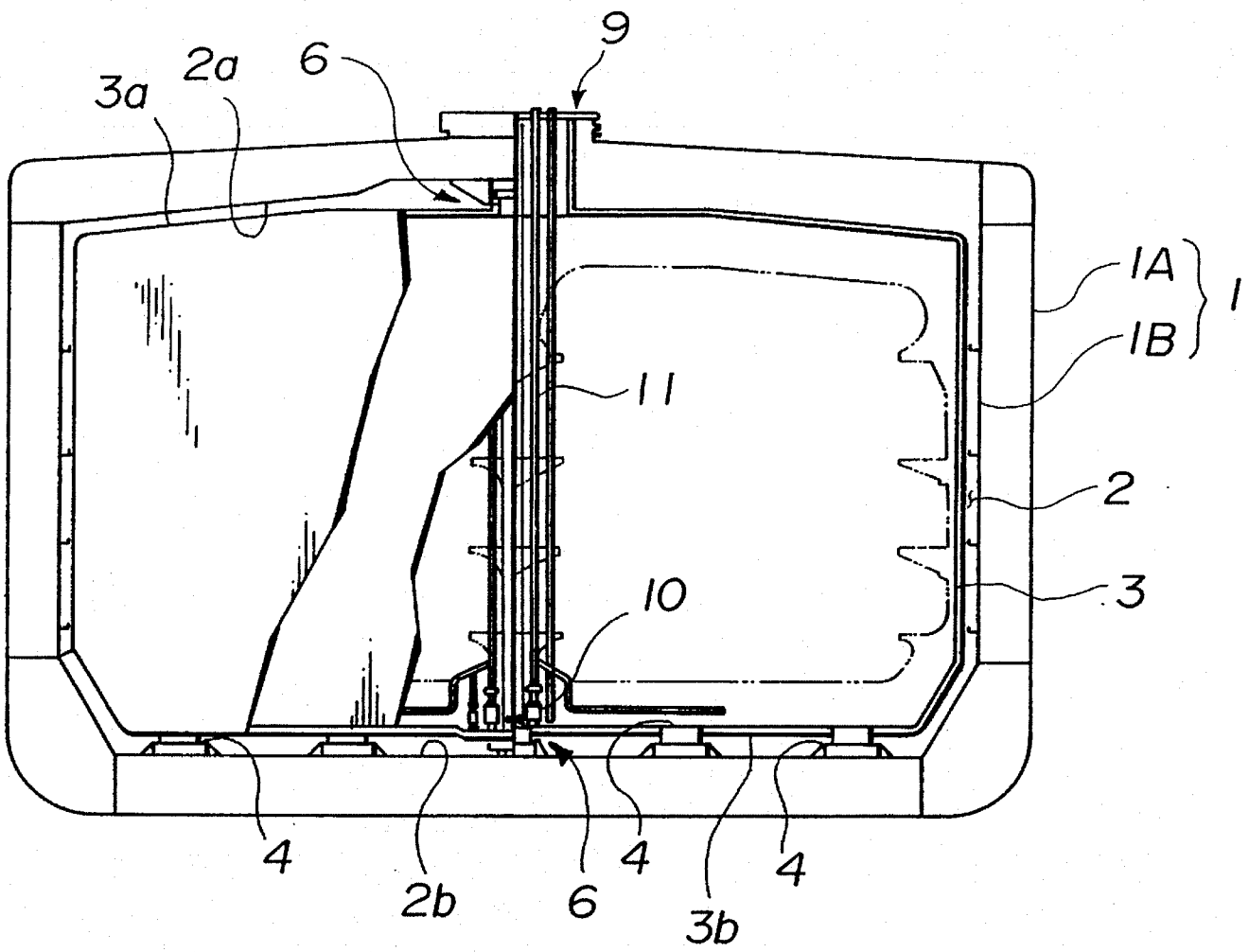
FIG. 11 is a sectional view taken along line XI—XI in FIG. 10.
Figure 12:
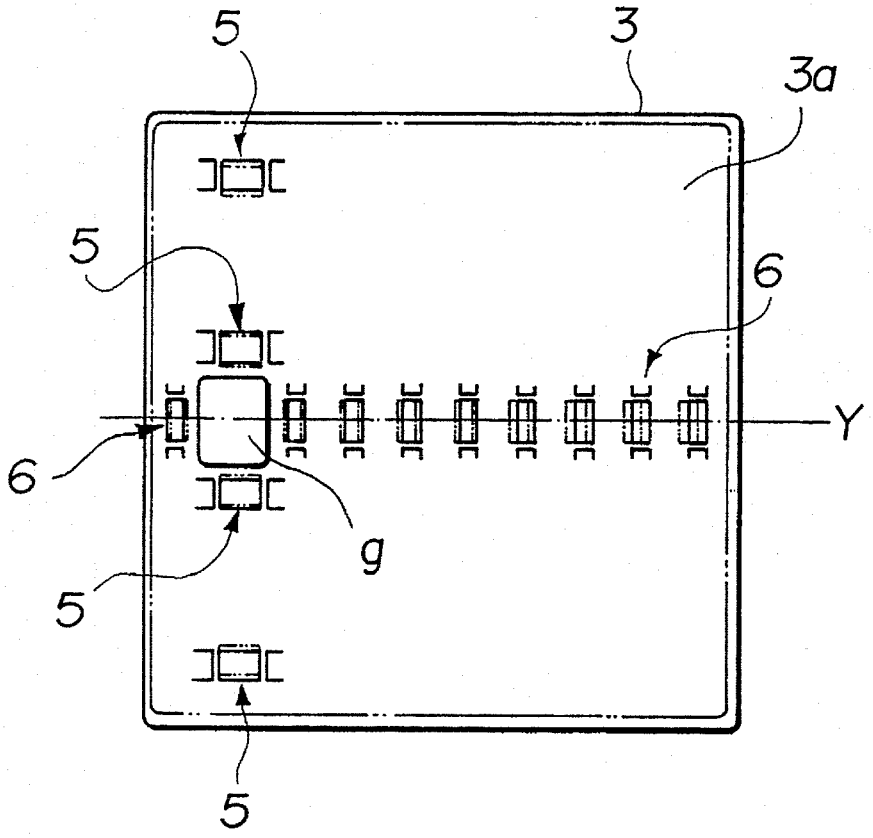
FIG.12 (PRIOR ART)
FIG. 12 is a plan view of a conventional support structure at the upper section of a storage tank.

FIG. 1 shows a part of a section of the portion in which a self-standing storage tank in a ship's hull 1 of the liquid-transport carrier ship as shown in FIG. 10 is disposed. Fore-aft movement restraining devices and lateral movement restraining devices, which are further described below, are omitted in FIG. 1. As shown in FIG. 1, the ship's hull 1 is constituted so as to have a double structure (armored-structure) comprising an outer shell 1A and an inner shell 1B, and the hull 1 forms therein holds 2 for housing self-standing storage tanks 3. Each of the storage tanks 3 is mounted in a self-standing state on a plurality of support blocks 4 arranged on a bottom surface **2*b* of the hold 2. In this embodiment, the tank 3** is constructed of aluminum alloy sheets.

Figure 2:
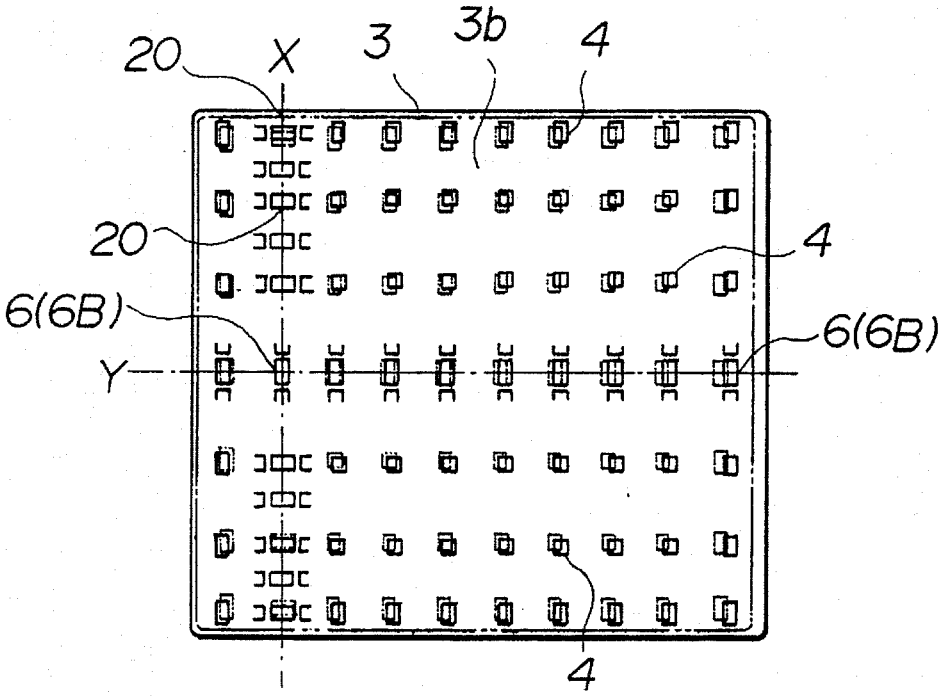
FIG. 2 is a plan view of a support structure at the lower section for a self-standing storage tank in accordance with an embodiment of the present invention.
Figure 3:
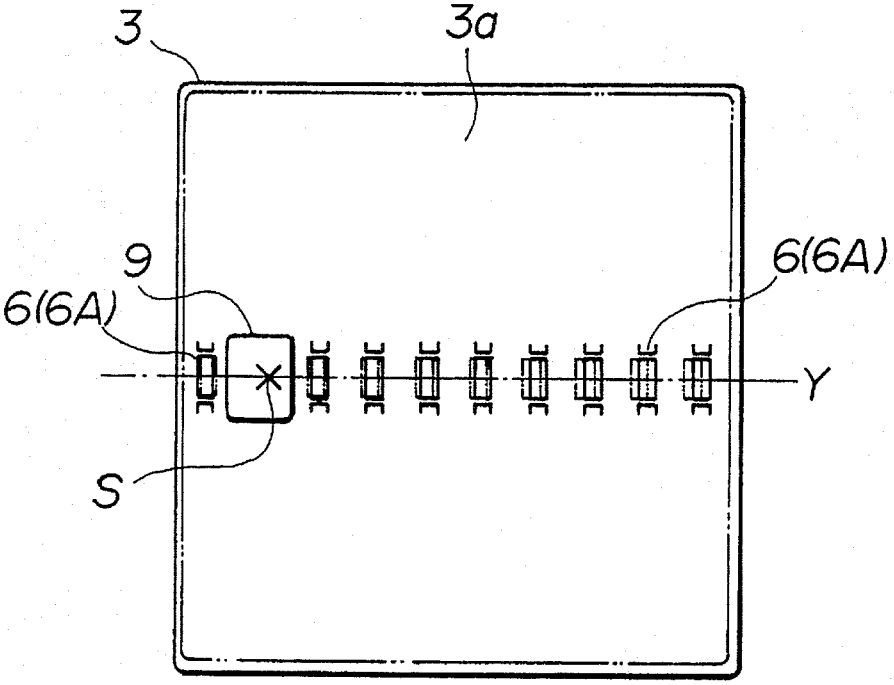
FIG. 3 is a plan view of a support structure at the upper section for a self-standing storage tank in accordance with an embodiment of the present invention.

FIG. 2 shows a support structure which is constructed under the tank 3. As shown in FIG. 2, required numbers of lateral movement restraining devices 6 (6B) and fore-aft movement restraining devices 20 are disposed between the bottom surface **2*b* of the hold 2 and a bottom section 3*b* of the tank 3. On the other hand, FIG. 3 shows a support structure which is constructed above the tank 3. As shown in FIG. 3, in between a roof section 3***a* of the tank 3 and a roof surface 2*a* of the hold 2, only lateral movement restraining devices 6 (6A) are disposed, and there is no fore-aft movement restraining device disposed at this location.

As shown in FIG. 2, the lateral movement restraining devices 6B disposed in the lower position are arranged along the center line Y of the tank 3, which extends in the longitudinal direction of the ship, and are disposed in predetermined spaced relation. The fore-aft movement restraining devices 20 are arranged along the line x which is transverse to the line Y and passes the position corresponding to the restraining base point S, disposed in predetermined spaced relation. The restraining base point S is positioned at approximately the center of a tank dome 9 provided with an opening for the passing of lines into the tank 3. Thus, when the tank 3 contracts when it is filled with low temperature liquefied gas such as LNG, as indicated by chain lines in FIGS. 2 and 3, the contraction of the tank 3 is centered at the center of the tank dome 9. Accordingly, the dislocation of the tank dome 9 is prevented, and thus the dislocation of a pump 10 and lines 11 provided adjacent to the center position of the tank dome 9 can be avoided.

The lateral movement restraining devices 6 (6A) disposed at the upper position are also arranged, as shown in FIG. 3, along the center line Y of the tank 3, which extends in the longitudinal direction of the ship, and in predetermined spaced relation from one another.

In the support structure in accordance with the present invention, since the fore-aft movement restraining devices 20 are disposed only at the lower position, load caused by a collision is distributed among the support blocks 4 and the fore-aft movement restraining devices 20. For example, if is supposed that the collision load is 0.5 G (gravity), the number, the size, and the capacity of the support blocks 4 and the fore-aft movement restraining devices 20 are chosen such that the former absorbs 0.45 G and the latter absorbs 0.05 G.

Next, referring to FIGS. 4 and 5, specific structures of the lateral movement restraining devices 6A disposed at the upper position will be explained below.

The lateral movement restraining device 6A is constituted by a pair of stopping blocks 21 arranged on the roof surface 2*a* of the hold 2 constituted by the inner shell 1B, each stopping block spaced apart from the other and integrated with the inner shell 1B, and a chock 22 provided on the roof section 3*a* of the tank 3 and disposed between the pair of stopping blocks.

Figure 4:
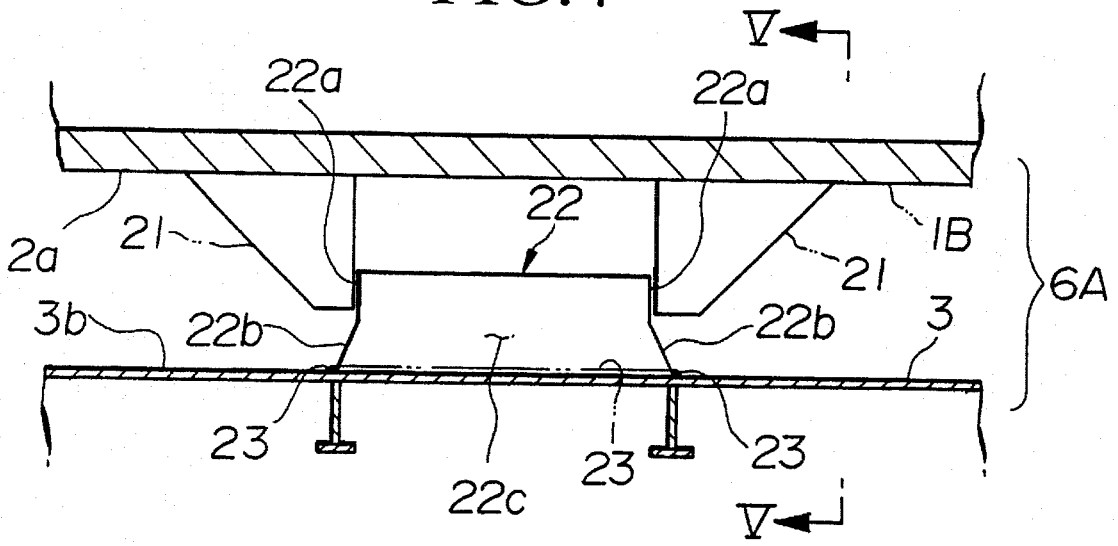
FIG. 4 is a side view of a movement restraining device in accordance with the present invention.
Figure 5:
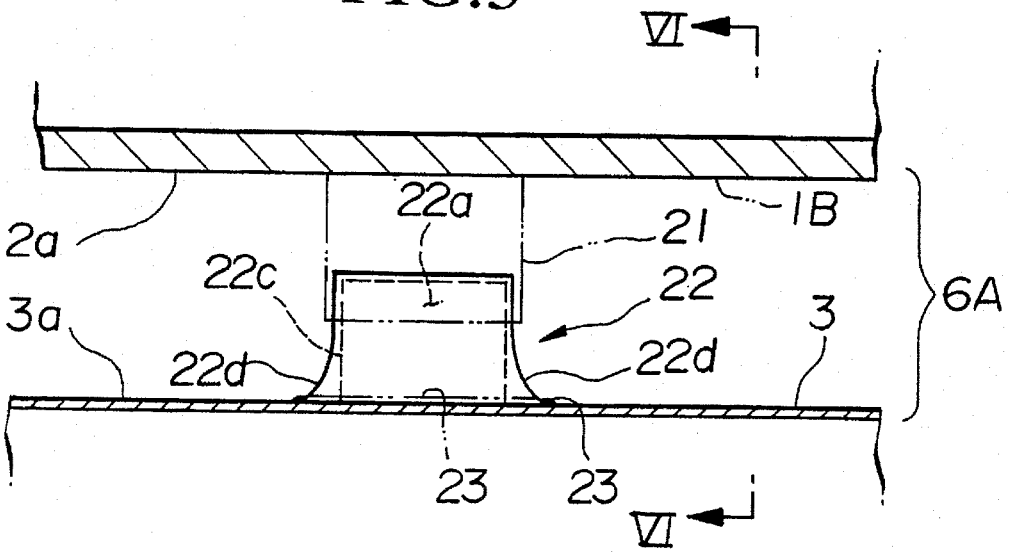
FIG. 5 is a sectional view taken along line V—V in FIG. 4.

As shown in FIG. 4, at the base portion of end surfaces 22*a* of the chock 22, which may contact the stopping blocks 21, skirt sections 22*b* sloping toward the stopping blocks are formed. Furthermore, the base portion of lateral surfaces 22*c* of the chock 22, which is transverse to the end surfaces 22*a*, extends outwardly to form flared portions 22*d*. The skirt sections 22*b* of the end surfaces 22*a* and the flared portion 22*a* of the lateral surfaces 22*c* are integrated with each other, and base portions of the skirt sections 22*b* and the flared portion 22*d* are welded to an outer surface of the tank 3.

Based on the above structure, when the chock 22 comes into contact with the stopping blocks 21 and thus an external force is applied to the end surfaces 22*a*, stress occurs at the weld section 23, since the relative movements of the chock 22 and the stopping blocks 21 are restrained. Then, forces in the end surface 22*a* of the chock 22 occurring in the direction in which the movements are restrained (that is, in the direction in which the pair of stopping blocks 21 face each other) are distributed, since the end surface 22*a* forms the skirt sections 22*b*. Thus, it is contemplated that the amount of stress at the weld section 23 may be reduced. Furthermore, forces in the lateral surfaces 22*c* of the chock 22 occurring in the transverse direction in which the movements are restrained are distributed. Therefore, it is also contemplated that the amount of stress at lateral portions of the weld section 23 may be reduced.

Analytical Model

Figure 6:
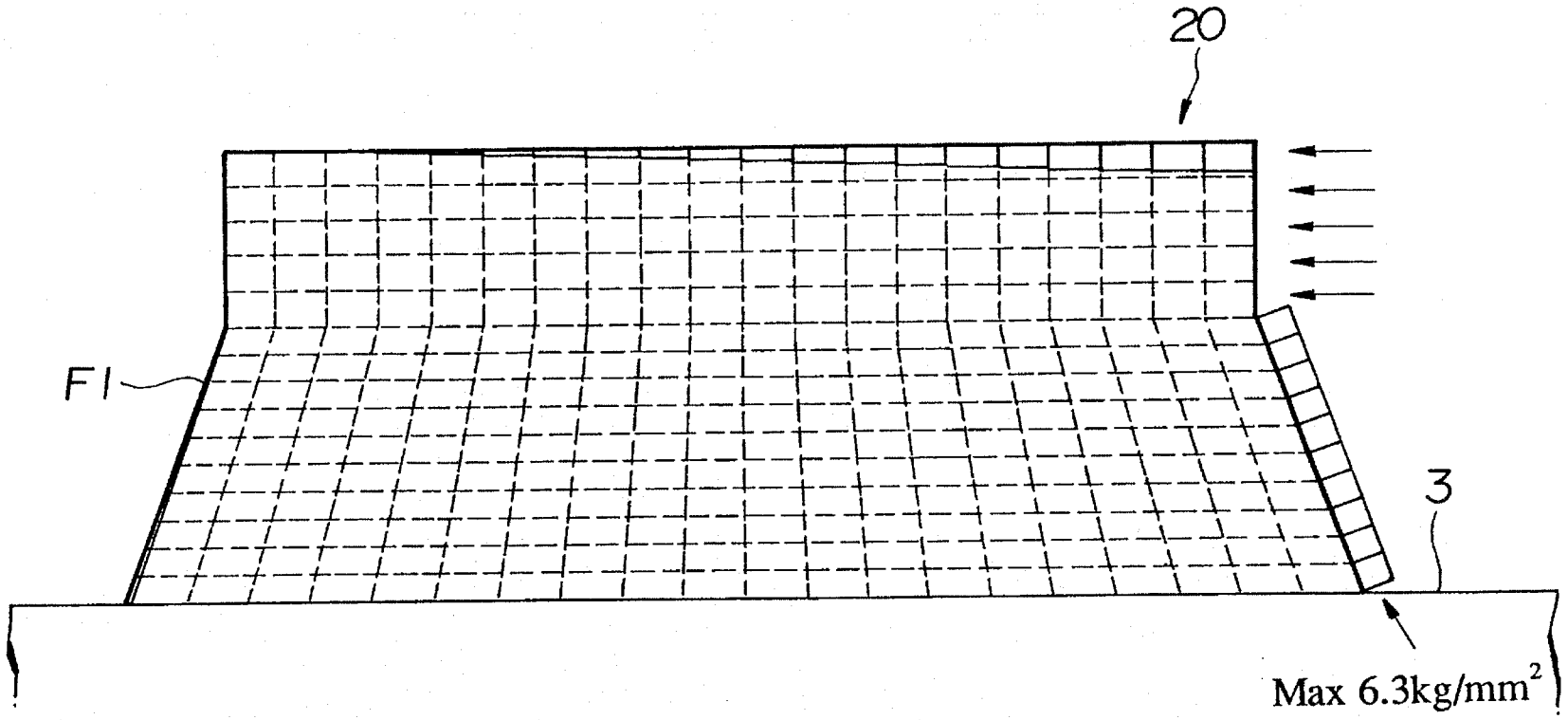
FIG. 6 is a stress analysis map of a chock as shown in FIG. 4.
Figure 7:
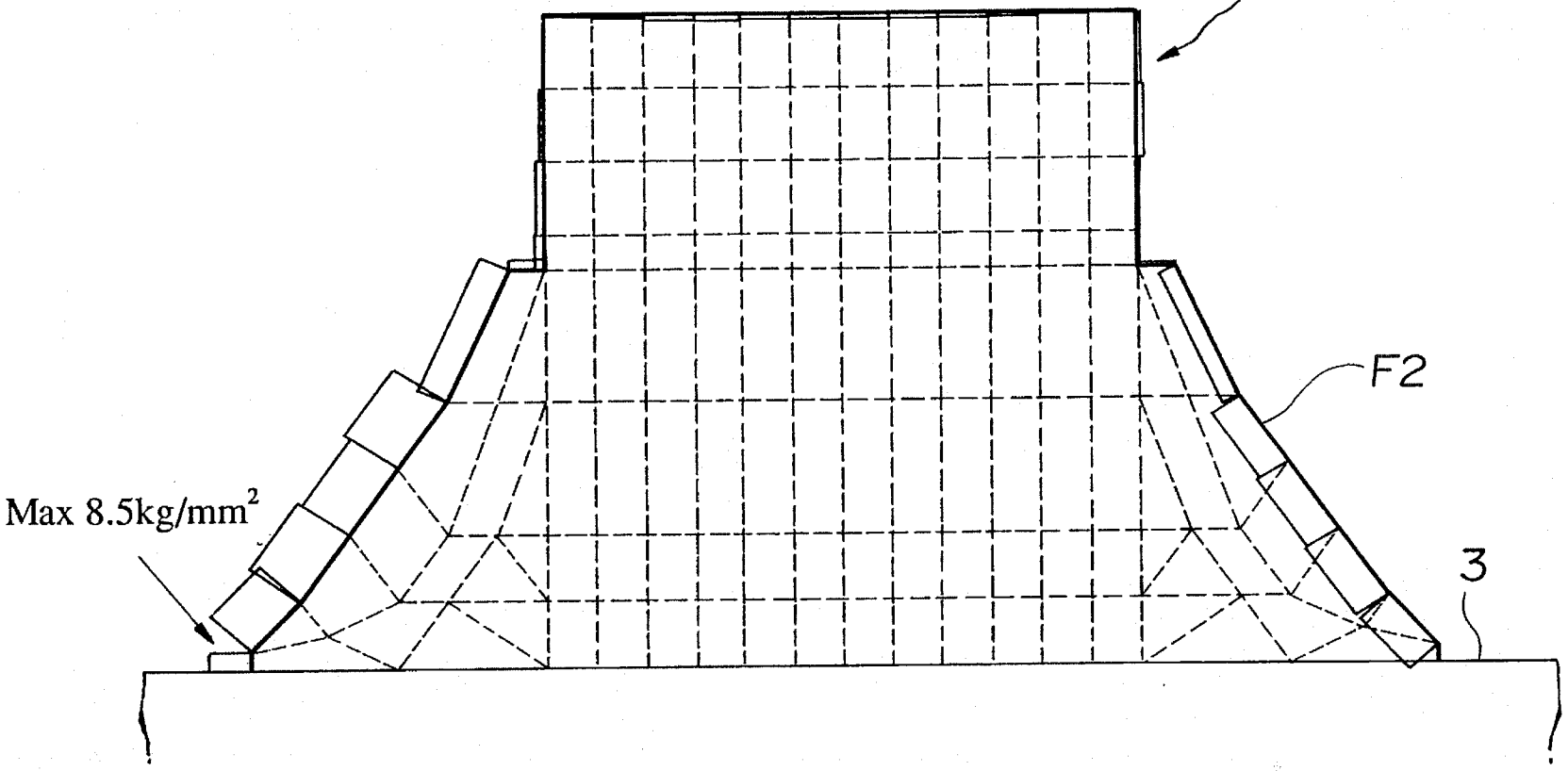
FIG. 7 is a stress analysis map of a chock as shown in FIG. 4.
Figure 8:
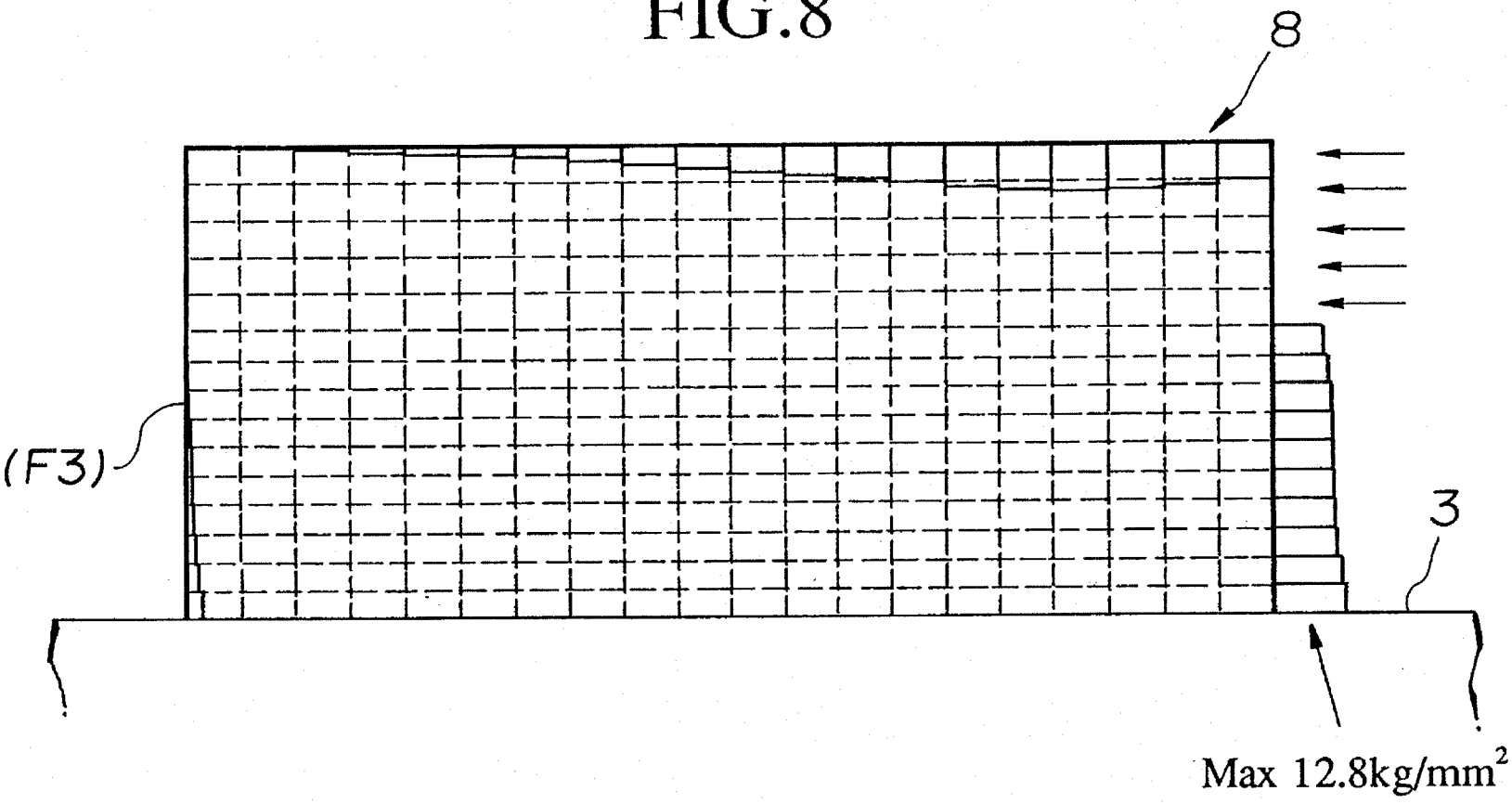
FIG. 8 is a stress analysis map of a chock as shown in FIG. 13.
Figure 9:
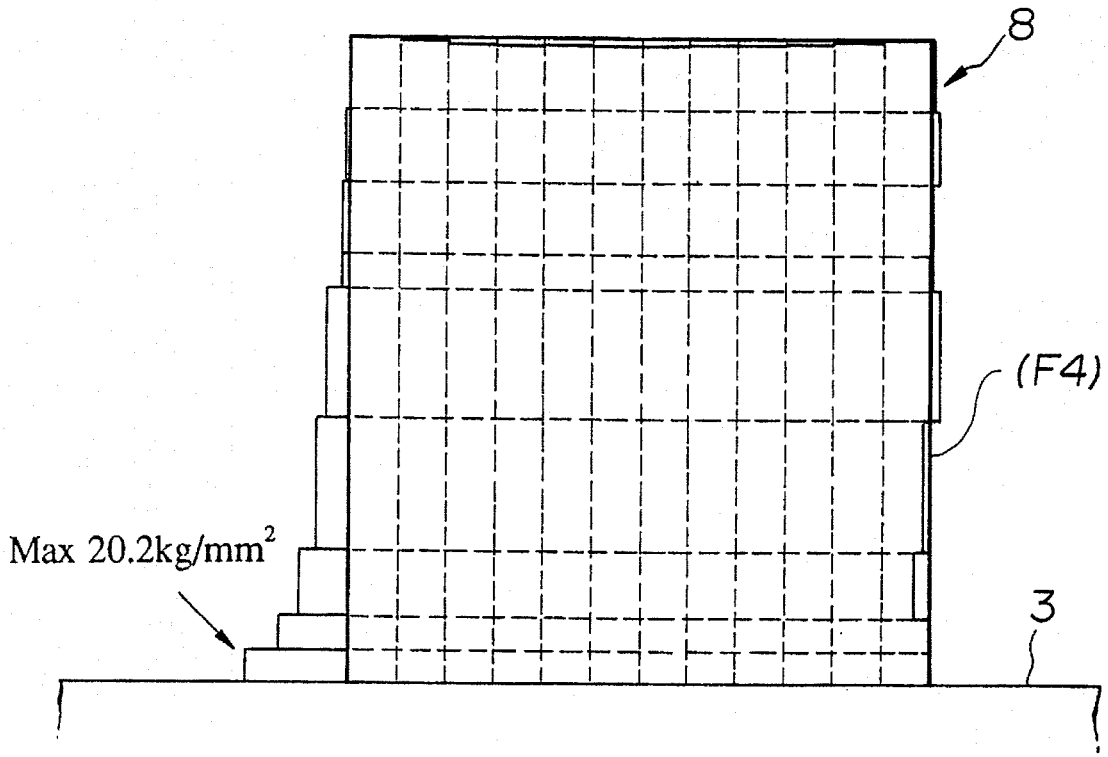
FIG. 9 is a stress analysis map of a chock as shown in FIG. 13.

FIGS. 6 and 7 show an example of a stress analysis map of the chock 22 in accordance with the present invention, wherein 200,000 kg of the load was applied to one of the end surfaces 22*a* of the chock 22. In contrast, FIGS. 8 and 9 show an example of a stress analysis map of the chock 8 in FIG. 13. In these FIGS. 6 to 9, squares protruding from each line F1, F2, F3, and F4 drawn with solid lines show tensile stresses, squares which are inset inside each line F1, F2, F3, and F4 show compressive stresses, and the height of the squares shows the magnitude of the stress.

The conditions for the analysis for the chock 22 in FIGS. 6 and 7 were as follows.

Material of the tank 3: Al-5083-(annealing refining),
thickness of the tank: 18 mm,
material of the chock 22: Al-5083-(annealing refining),
height of the end surface 22*a:* 300 mm,
width of the end surface 22*a:* 800 mm,
height of the chock 22: 900 mm,
width of the chock 22: 800 mm,
length of the upper surface of the chock 22: 2000 mm,
length of the base portion of the chock 22 including the skirt sections: 2400 mm,
height of the flared portion 22*d:* 600 mm,
thickness of the flared portion 22*d:* 25 mm, and
width of flared portion 22*d:* 1600 mm.

Figure 13:
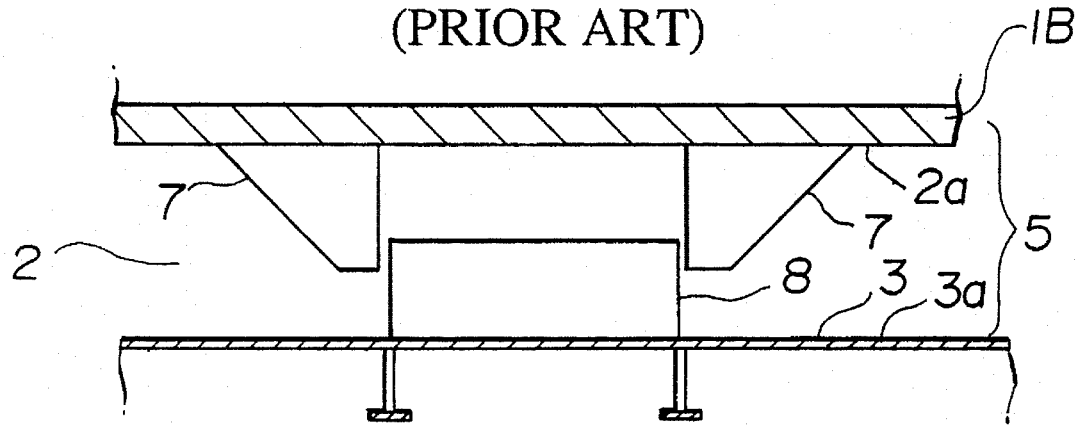
FIG.13 (PRIOR ART)
FIG. 13 is a side view of a conventional movement restraining device.
Figure 14:
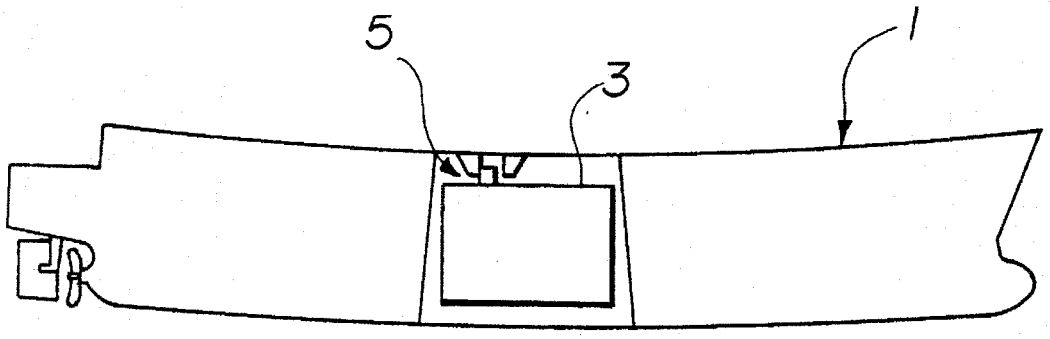
FIG. 14 is a side view of a liquid-transport carrier ship showing an example of a deformation thereof.
Figure 15:
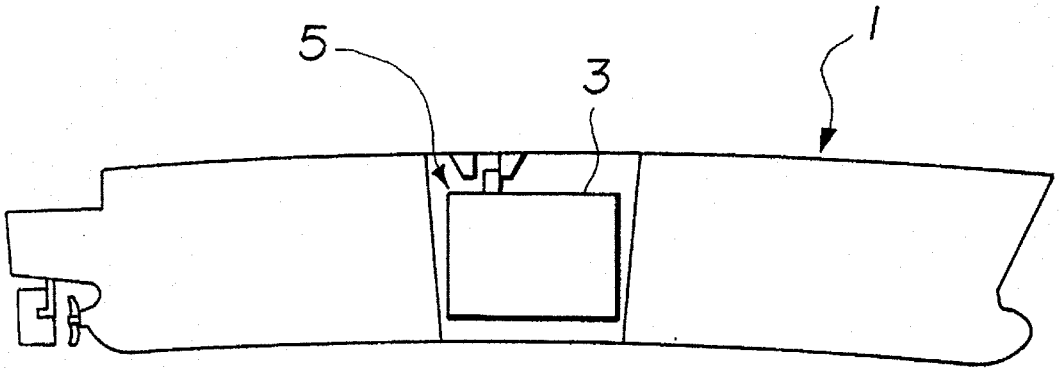
FIG. 15 is a side view of a liquid-transport carrier ship showing another example of deformation thereof.

The conditions for the analysis for the chock 8 in FIG. 13 were as follows.

Material of the tank 3: Al-5083-(annealing refining),
thickness of the tank: 20 mm,
material of the chock 8: Al-5083-(annealing refining),
height of the contact section of the chock 8: 300 mm,
length of the chock 8: 2000 mm,
height of the chock 8: 900 mm, and
width of the chock 8: 800 mm.

Results of Stress Analysis

The results of the analysis are as follows.

With respect to the chock 22 in accordance with the present invention, tensile stresses occurring in the section adjacent to the welded portion 23 of the skirt section 22*b* were 6.3 kg/mm$^2$, as shown in FIG. 6. In contrast, with respect to the chock 8, tensile stresses occurring in the comparable section were 12.8 kg/mm$^2$, as shown in FIG. 8. Thus, the advantages of the chock 22 are obvious.

With respect to FIGS. 7 and 9, it is supposed that 200,000 kg of load was applied to the end surface 22*a*, and that 120,000 kg of frictional resistance was added thereto. In this situation, tensile stresses occurring in the section adjacent to the weld portion 23 of the flared portion 22*d* were 8.5 kg/mm$^2$, as shown in FIG. 7. In contrast, as shown in FIG. 9, the same stresses occurring in the comparable section were 20.2 kg/mm$^2$. Thus, the advantages of the chock 22 are obvious.

As explained above, according to the support structure for a self-standing storage tank used in a liquefied gas carrier ship in accordance with the present invention, since there is no fore-aft movement restraining device above the tank, if displacement in the forward and rearward directions occurs between the ship's hull 1 and the top of the tank 3 by deformation of the ship's hull 1, the tank 3 is not restricted at the top portion thereof. Furthermore, this support structure makes it possible to simplify the installation work for the fore-aft movement restraining devices, and to omit the calculations for design and the adjustment work for the fore-aft movement restraining devices for the upper position, which are related to the fore-aft movement restraining devices to be disposed at the lower position. Thus, the amount of labor can be reduced. Furthermore, compared to the support structures in which fore-aft movement restraining devices are disposed above the tank, the probability of the occurrence of breakage inside the ship's hull can be reduced, and it is possible to reduce the amount of maintenance inspection necessary. Additionally, by precluding the interactions of the top of the tank and the inner upper section of the hold, the effects on installed equipment disposed at the position corresponding to the restraining base point can be reduced, and this improves safe operation of the ship.

Furthermore, by adopting a composition in which the skirt sections **22*b* inclined outwardly are formed at the base portion of the chock, the amount of stress occurring at the adjacent portion of the welded portion can be reduced, and the reliability of the tank can be ensured with no fore-aft movement restraining device above the tank 3. Moreover, by forming the flared portions 22*d*** at the lateral sides of the base portion of the chock, the amount of stress occurring in that portion can also be reduced.

In the present invention, the following techniques can also be adopted instead of the aforementioned embodiments.

a) The incline of the skirt sections **22*b* of the chock 22** may be formed as curves.

b) The thickness of the flared portions **22*d* of the chock 22**, in the forward and rearward directions, may be increased.

In the above embodiments, a support structure is disclosed in which the pair of stopping blocks is provided on the ship's shell and the chock is provided on the tank. However, in the present invention, it is possible to adopt another structure in which the pair of stopping blocks are provided on the tank and the chock is provided on the ship's shell.

Furthermore, the aforementioned support structure can be adopted not only for the carrier ship which has a double casing type (armored-type) hull, but also for that having a single casing type hull.

What is claimed is:

1. A support structure for a self-standing storage tank used in a liquid-transport carrier ship, said self-standing storage tank having a roof section, a bottom section, and a tank dome disposed at the upper part of said tank for passing lines into said tank, said support structure comprising:

a hold for housing said self-standing storage tank in a self-standing state, said hold having a roof surface facing said roof section of said tank and a bottom surface facing said bottom section of said tank;

lateral movement restraining devices for restraining movements of said tank in the widthwise direction of said ship, said lateral movement restraining devices being disposed between said bottom section of said tank and said bottom surface of said hold, and between said roof section of said tank and said roof surface of said hold, said lateral movement restraining devices being aligned along a widthwise center line of said tank; and fore-aft movement restraining devices for restraining movements of said tank in the fore-aft direction of said ship, said fore-aft movement restraining devices being disposed only between said bottom section of said tank and said bottom surface of said hold, said fore-aft movement restraining devices being aligned in the widthwise direction of said tank;

wherein said fore-aft movement restraining devices and said lateral movement restraining devices which are disposed at the lower part of said tank, and said lateral movement restraining devices which are disposed at the upper part of said tank, are arranged such that any line drawn through said fore-aft movement restraining devices and said lateral movement restraining devices intersects said tank dome in plan view, and thereby said support structures are defined such that a position corresponding to said tank dome is anchored as a restraining base point of movement of said tank.

2. A support structure for a self-standing storage tank according to claim 1, wherein said self-standing storage tank is generally formed in a rectangular box shape.

3. A support structure for a self-standing storage tank according to claim 1, wherein said self-standing storage tank is placed on a plurality of support blocks disposed between said bottom section of said tank and said bottom surface of said hold.

4. A support structure for a self-standing storage tank according to claim 1, wherein said lateral movement restraining devices and said fore-aft movement restraining devices comprise:

a pair of stopping blocks, integrated with an inner surface of a ships shell constituting said hold, protruding from said inner surface, each of said pair of stopping blocks disposed in spaced relation to the other; and a chock, integrated with an outer surface of said tank and protruding from said outer surface, said chock disposed between said pair of stopping blocks.

5. A support structure for a self-standing storage tank according to claim 4, wherein said stopping blocks are welded on said ship's shell constituting said hold, and said chocks are welded on said tank.

6. A support structure for a self-standing storage tank according to claim 4, wherein said chock has skirt sections inclined outwardly at a base portion of lateral end surfaces facing said stopping blocks.

7. A support structure for a self-standing storage tank according to claim 5, wherein said chock has flared portions inclined outwardly at a base portion of lateral surfaces extending parallel to the facing direction of said pair of stopping blocks.

8. A support structure for a self-standing storage tank used in a liquid-transport carrier ship, said self-standing storage tank having a roof section and a bottom section, said support structure comprising:

a hold for housing said self-standing storage tank in a self-standing state, said hold having a roof surface facing said roof section of said tank and a bottom surface facing said bottom section of said tank;

lateral movement restraining devices for restraining movements of said tank in the widthwise direction of said ship, said lateral movement restraining devices being disposed between said bottom section of said tank and said bottom surface of said hold, and between said roof section of said tank and said roof surface of said hold; and fore-aft movement restraining devices for restraining movements of said tank in the fore-aft direction of said ship, said fore-aft movement restraining devices being disposed only between said bottom section of said tank and said bottom surface of said hold;

wherein said lateral movement restraining devices and said fore-aft movement restraining devices comprise a pair of stopping blocks and a chock, said stopping blocks being welded on, and protruding from, an inner surface of a ship's shell constituting said hold, each of said pair of stopping blocks being disposed in spaced relation to the other, said chock being welded on, and protruding from, an outer surface of said tank, said chock being disposed between said pair of stopping blocks and having flared portions inclined outwardly at a base portion of lateral surfaces extending parallel to the facing direction of said pair of stopping blocks.

9. A support structure for a self-standing storage tank according to claim 8, wherein said self-standing storage tank is generally formed in a rectangular box shape.

10. A support structure for a self-standing storage tank according to claim 8, wherein said self-standing storage tank is placed on a plurality of support blocks disposed between said bottom section of said tank and said bottom surface of said hold.

11. A support structure for a self-standing storage tank according to claim 8, wherein said lateral movement restraining devices are disposed along a widthwise center line of said tank.

12. A support structure for a self-standing storage tank according to claim 8, wherein said fore-aft movement restraining devices are aligned in the widthwise direction of said ship.

13. A support structure for a self-standing storage tank according to claim 8, wherein said chock has skirt sections inclined outwardly at a base portion of lateral end surfaces facing said stopping blocks.

* * * * *